US005821462A

United States Patent [19]

Raleigh et al.

[11] Patent Number: 5,821,462

[45] Date of Patent: Oct. 13, 1998

[54] INSULATED TERMINAL AND METHOD OF CONSTRUCTING SAME

[75] Inventors: Michael P. Raleigh, Buffalo Grove; David Banasiak, Chicago, both of Ill.

[73] Assignee: Corcom, Inc., Libertyville, Ill.

[21] Appl. No.: 560,663

[22] Filed: Nov. 20, 1995

[51] Int. Cl.[6] ..... H01R 13/627

[52] U.S. Cl. ..... 174/79; 174/81; 174/99 R

[58] Field of Search ..... 174/74 R, 79, 174/81, 89, 99 R

[56] References Cited

U.S. PATENT DOCUMENTS

| | | | |
|---|---|---|---|
| 4,319,799 | 3/1982 | Pearce, Jr. | 339/217 R |
| 4,602,836 | 7/1986 | Garretson et al. | 339/59 R |
| 4,788,851 | 12/1988 | Brault | 73/49.2 |
| 5,096,443 | 3/1992 | Myrick et al. | 439/681 |
| 5,266,056 | 11/1993 | Baderschneider et al. | 439/745 |
| 5,314,358 | 5/1994 | Klemmer et al. | 439/741 |
| 5,342,223 | 8/1994 | Geib | 439/752 |
| 5,525,070 | 6/1996 | Axelsson | 439/268 |

*Primary Examiner*—Kristine L. Kincaid
*Assistant Examiner*—Marc D. Machtinger
*Attorney, Agent, or Firm*—Hill & Simpson

[57] ABSTRACT

An electrical contact is mounted in the insulated body portion and is locked therein between a pair of shoulders by a flexible tube. An electrical connector has an insulator body portion which can be extended through an opening of a housing and is then upset by ultrasonic welding to lock it to the enclosure. Electrical leads are inserted through the electrical contact and are connected to it by crimping and/or welding to provide an electrical connection.

4 Claims, 1 Drawing Sheet

INSULATED TERMINAL AND METHOD OF CONSTRUCTING SAME

BACKGROUND OF THE INVENTION

1. Field of the Invention

This invention relates in general to terminals, and in particular to a novel insulated terminal and a method of forming such a terminal.

2. Description of Related Art

Electronic apparatus insulated terminals are known which are mounted in the conducting walls of cases and housings.

SUMMARY OF THE INVENTION

The present invention relates to a novel pre-assembled insulated terminal. The insulated terminal which has a portion which can be inserted through an opening in an enclosure after which the insulator is upset by ultrasonic welding so as to lock the insulated terminal to the enclosure. Electrical leads can then be inserted through the insulated terminal and crimped and/or electrically welded to the terminal so as to provide an improved electrical connection.

The ultrasonic welding forms a solid connection between the insulated terminal and the enclosure.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure.

DETAILED DESCRIPTION OF THE PREFERRED EMBODIMENTS

Figure 1:
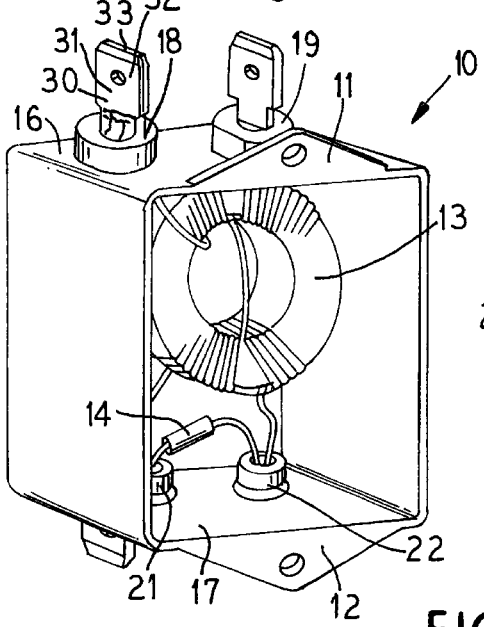
FIG. 1 is a perspective view illustrating an enclosure with electrical components and a number of terminals according to the invention mounted therein.

FIG. 1 illustrates an enclosure 10 which may have mounting flanges 11 and 12 through which suitable holes are formed for mounting the enclosure 10 to a surface. Electrical components, such as, but not limited to, a toroid coil 13 and a resistor 14 are mounted in the enclosure 10 and are connected together by suitable electrical leads, such as leads 41 and 42. The coil 13 and the resistor 14 and the associated electrical leads are attached to an upper wall 16 and a lower wall 17 of the enclosure 10 by insulated terminals 18, 19, 21 and 22.

Figure 2:
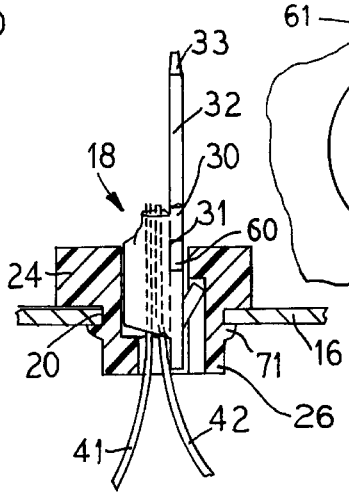
FIG. 2 a sectional view through the insulated terminal.
Figure 3:
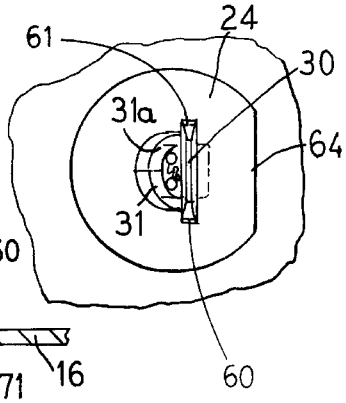
FIG. 3 is a top plan view through the completed terminal.
Figure 4:
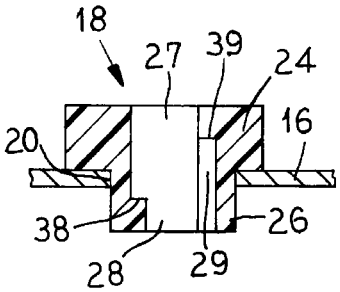
FIG. 4 is a sectional view illustrating the terminal insulator.

FIGS. 2–9 illustrate the insulating terminals and the electrical contacts. The insulator portion of each the insulating terminals 18, 19, 21 and 22 are formed with a larger cylindrical portion 24 which has a flat spot 64 as illustrated in FIG. 3, and each of the insulators has a smaller hexagonal shaped portion 26 which can be inserted through an opening 20 in the enclosure wall 16 as shown in FIG. 4. Each of the insulators has a larger central opening 27 that extends through the portion 24 and a smaller communicating central opening 28 which extends through the portion 26. A ledge 38 is formed between the openings 27 and 28 as shown in FIG. 4 for example, and a ledge 39 is formed in the portion 26 in an opening 29 as shown in FIG. 4. Each of the electrical contacts 30 has an extending electrical terminal 32 that may be formed with an opening 35 and terminate in a tapered point 33. A pair of curved portions 31 and 31*a* are an integral part of the electrical contact 30 and are received in the opening 27 as illustrated in the terminal FIGS. 5 and 6. A tab 37 is connected to the electrical contact 30 and extends outwardly so when inserted into the insulated terminal 18, the end of the tab 37 engages the shoulder 39 to prevent the electrical contact 30 from being moved upwardly relative to the terminal. A lower portion 46 of the electrical contact 30 is flat and extends through the lower opening 28. Two additional tabs 60 and 61 extend outwardly from the electrical contact 30 so when inserted into the insulator 18, they prevent the electrical contact 30 from moving horizontally as illustrated in FIG. 2.

Figure 5:
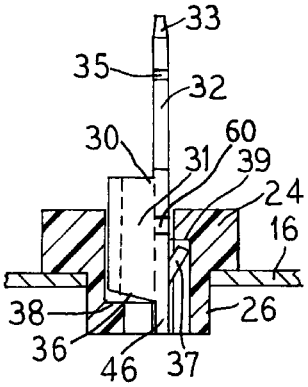
FIG. 5 illustrates the insulated terminal with an electrical connector mounted therein.
Figure 6:
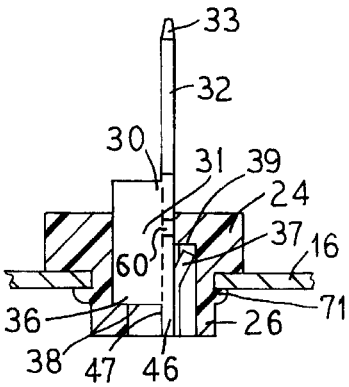
FIG. 6 illustrates the terminal after it has been ultrasonic welded.
Figure 8:
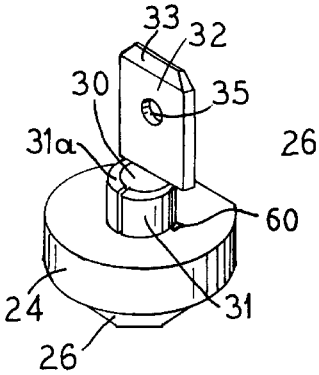
FIG. 8 is a perspective view showing the electrical contact and the insulating terminal.
Figure 9:
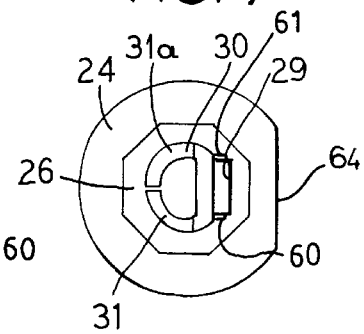
FIG. 9 is a bottom plan view of the insulated terminal.

To mount the electrical contact 30 and the insulator 18 in the opening 20 of the wall 16, the portion 26 is inserted through the opening 20 and the lower octagonal portion 26 is subjected to ultrasonic welding so as to upset it to form a ledge 71 on the lower side of the wall 16 so as to lock the insulator 18 to the wall 16. Prior to inserting the insulator 18 through the wall 16 and conducting the ultrasonic welding, the electrical contact 30 is inserted in the insulator 18 as shown in FIGS. 5 and 8 wherein the flat extending portion 46 is inserted through the portion 26 until the portion 36 of the portion 31 engages the shoulder 38, and the extending tab 37 is received in the opening 29 such that the tab 37 is engageable with the ledge 39 to prevent the electrical contact 30 from being removed from the insulator 18 and the tabs 60 and 61 are firmly engaged into portions of the portion 24.

Figure 7:
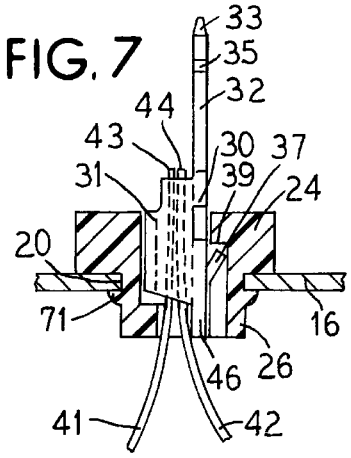
FIG. 7 a sectional view illustrating electrical leads which are crimped and welded to the electrical contact.

Portions of electrical leads 41 and 42 illustrated in FIGS. 2 and 7 are then inserted through the opening 28 and through the arcuate portions 31 and 31*a* of the electrical contact 30, and portions of the arcuate portions 31 and 31*a* are crimped and/or electronically welded to the portions of the leads 41 and 42 as shown in FIG. 7.

The octagonal shape of the portion 26 and the flat portion 61 of the portion 24 allow the connector to be held in a fixed angular position during installation.

It is seen that this invention provides a new and novel insulated terminal with an electrical contact, and although the invention has been described with respect to preferred embodiments, it is not to be so limited as changes and modifications can be made which are within the full intended scope of the invention as defined by the appended claims.

We claim as our invention:

1. An insulated electrical terminal which is mounted in an opening of an enclosure, the terminal comprising:

an insulated body portion formed with a central opening and having a larger portion integrally formed with a smaller extending portion wherein the smaller extending portion extends through said opening in said enclosure;

a ledge integrally formed on an exterior wall of said smaller extending portion creating an interference fit to lock the insulated body portion to said enclosure wherein a reduced diameter section is formed between the ledge and the larger portion of the insulated body portion; and an electrical conductor with an extending connector mounted in said central opening of said insulated body portion and locked thereby by an extending tab wherein at least one electrical lead is connected to said electrical conductor.

2. The electrical terminal according to claim 1 wherein said smaller extending portion is octagonal shaped.

3. The electrical terminal according to claim 1 wherein said larger portion has a flat spot.

4. The electrical terminal according to claim 1 wherein said larger portion has a pair of curved portions which can be connected to said at least one electrical lead by crimping or welding.

* * * * *